United States Patent [19]

Ivanditto

[11] Patent Number: 4,794,739

[45] Date of Patent: Jan. 3, 1989

[54] SANDPAPER CLEANING TOOL

[76] Inventor: Joseph Ivanditto, 593 Old Country Rd., Deer Park, N.Y. 11729

[21] Appl. No.: 82,494

[22] Filed: Aug. 7, 1987

[51] Int. Cl.[4] ..... B24B 23/00

[52] U.S. Cl. ..... 51/262 A; 15/141.1

[58] Field of Search ..... 51/262 A; 15/141.1; D8/15

[56] References Cited

U.S. PATENT DOCUMENTS

| | | | |
|---|---|---|---|
| 458,090 | 8/1891 | Zimmermann | 15/141.1 |
| 499,987 | 6/1893 | Goodenough | 15/141.1 |
| 546,870 | 9/1895 | Younkin | 15/141.1 |
| 1,408,564 | 3/1922 | Cowles | 15/141.1 |

*Primary Examiner*—Roscoe V. Parker

*Attorney, Agent, or Firm*—Michael I. Kroll

[57] ABSTRACT

A sandpaper cleaning tool is provided and consists of a wire loop extending from a handle which when the loop is hit against backing of a piece of used sandpaper, dirt from abrasive coating of the sandpaper will be dislodged, so that operating life of the sandpaper can be extended.

1 Claim, 1 Drawing Sheet

SANDPAPER CLEANING TOOL

BACKGROUND OF THE INVENTION

1. Field of the Invention

The instant invention relates generally to hand-held implements and more specifically it relates to a sandpaper cleaning tool.

2. Description of the Prior Art

Numerous hand-held implements have been provided in prior art that are adapted to be used to accomplish work in the performance of particular operations. While these units may be suitable for the particular purpose to which they address, they would not be as suitable for the purposes of the present invention as heretofore described.

SUMMARY OF THE INVENTION

A primary object of the present invention is to provide a sandpaper cleaning tool that will overcome the shortcomings of the prior art devices.

Another object is to provide a sandpaper cleaning tool that contains a wire loop extending from a handle which when hit against backing of a piece of used sandpaper, will dislodge dirt from abrasive coating of the sandpaper so that the operating life of the sandpaper can be extended.

An additional object is to provide a sandpaper cleaning tool that is fabricated out of durable light weight material.

A further object is to provide a sandpaper cleaning tool that is simple and easy to use.

A still further object is to provide a sandpaper cleaning tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
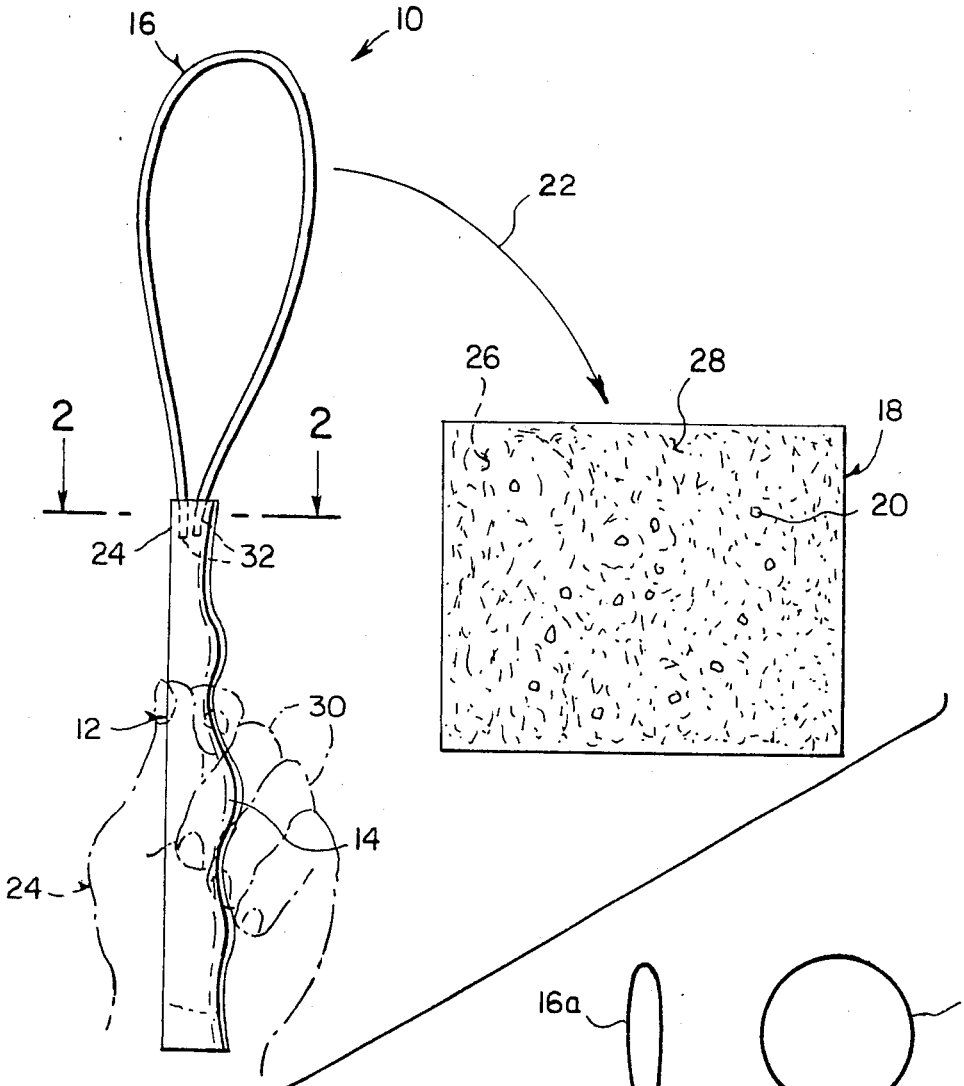
FIG. 1 is an elevational view of the invention being used to clean sandpaper.
Figure 2:
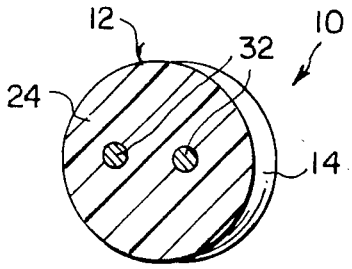
FIG. 2 is an enlarged cross sectional view taken along line 2—2 in FIG. 1.

Turning now descriptively to the drawings, in which similar reference characters denote similar elements throughout the several views, FIGS. 1 and 2 illustrate a sandpaper cleaning tool 10 consisting of an elongated handle 12 to be gripped by a hand 24 of a person using the tool 10. A wire loop 16 extends from distal end 24 of the handle 12. When the wire loop 16 is hit against backing 26 of a piece of used sandpaper 18, as indicated by arrow 22, dirt 20 from abrasive coating 28 of the sandpaper 18 will be disloged so that operating life of the sandpaper 18 can be extended.

The handle 12 further includes a finger grip 14 formed on one side therealong so that fingers 30 of the hand 24 of the person can increase their grip thereto. The ends 32 of the wire loop 16 are imbedded into the distal end 24 of the handle 12 and the wire loop 16 is in a regular shaped configuration.

Figure 3:
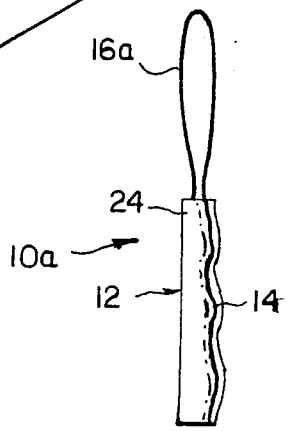
FIG. 3 is an elevational view of a first alternate configuration with a narrow loop wire.
Figure 4:
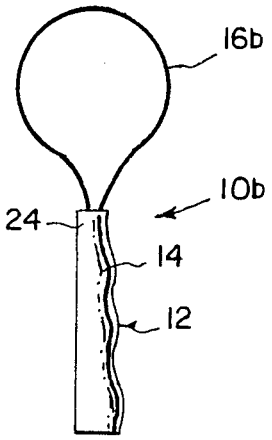
FIG. 4 is an elevational view of a second alternate configuration with a wide loop wire.

In FIG. 3 a first modification is shown wherein the wire loop **16*a* is in a narrow configuration. In FIG. 4 a second modification is shown wherein the wire loop 16*b* is in a wide configuration so that various sized pieces of sandpaper 18** can be cleaned.

It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing from the spirit of the invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. A sandpaper cleaning tool for use by a hand of a person, comprising:

(a) an elongated handle having a distal end and finger grips lying in a plane so that said handle will not rotate in the hand of the person and can be more better gripped by the hand of the person using the tool; and (b) a rigid one piece inflexible wire loop extending from said distal end of said handle, said rigid one piece wire loop having a pair of ends with a diameter and said distal end of said handle having a pair of holes with a diameter smaller than said diameter of said pair of ends of said rigid one piece wire loop so that when said pair of ends of said rigid one piece wire loop is imbedded into said pair of holes in said distal end of said handle said pair of holes will elastically compress tightly around said pair of ends of said rigid one piece wire and provide a tight fit, said rigid one piece wire loop lying in a plane that is coplanar with said plane that said finger grips of said handle lie in so that by merely flicking the wrist of the person said wire loop is hit against backing of a piece of used sandpaper and dirt from abrasive coating of the sandpaper will be dislodged and extend the operating life of the sandpaper.

* * * * *